US006279535B1

(12) United States Patent
Matsusaka

(10) Patent No.: US 6,279,535 B1
(45) Date of Patent: Aug. 28, 2001

(54) THROTTLE CONTROL DEVICE

(75) Inventor: Masanobu Matsusaka, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/428,984

(22) Filed: Oct. 29, 1999

(30) Foreign Application Priority Data

Oct. 29, 1998 (JP) ..... 10-308394

(51) Int. Cl.[7] ..... F02D 9/10
(52) U.S. Cl. ..... 123/399
(58) Field of Search ..... 123/361, 399

(56) References Cited

U.S. PATENT DOCUMENTS 6,000,377 * 12/1999 Sato et al. ..... 123/399 X

FOREIGN PATENT DOCUMENTS

19540323 * 4/1997 (DE) .
19704012 * 8/1998 (DE) .
6-264779 9/1994 (JP) .

* cited by examiner

*Primary Examiner*—Tony M. Argenbright
(74) *Attorney, Agent, or Firm*—Burns, Doane, Swecker & Mathis, LLP

(57) ABSTRACT

A throttle controller includes a main body to which is connected a body cover which accommodates therein a power transmitting mechanism constituted by a pinion gear, a secondary gear, and a final gear. Accommodated in the body cover are a built-in throttle sensor and a lever connecting the throttle sensor and the throttle shaft. The throttle controller is less complicated in construction, requiring a smaller number of parts, and allows realization of reduced production cost as compared to other known constructions. In addition, the assembly of the throttle sensor is easier.

20 Claims, 7 Drawing Sheets

THROTTLE CONTROL DEVICE

This application is based on and claims priority under 35 U.S.C. §119 with respect to Japanese Application No. 10(1998)-308394 filed on Oct. 29, 1998, the entire content of which is incorporated herein by reference.

FIELD OF THE INVENTION

The present invention generally relates to vehicle throttles. More particularly, the present invention pertains to a throttle control device associated with internal combustion engines for adjusting the amount of opening of a throttle valve by driving a motor connected to the throttle in response to the amount of depression of the acceleration pedal.

BACKGROUND OF THE INVENTION

Japanese Patent Laid-Open Publication No. Hei. 6-264779 published on Sep. 20, 1994 without examination discloses a known throttle control device that includes a throttle valve for adjusting the amount of air passing through the intake passage of an internal combustion engine and a throttle body in which is accommodated the throttle valve. The throttle body rotatably supports a throttle shaft to which the throttle valve is fixed. A motor is coupled to the throttle valve via a power transmission mechanism for open/close driving of the throttle valve, and a throttle sensor determines the opening amount of the throttle valve. A cover is also secured to the throttle body for accommodating the power transmission mechanism in a space between the cover and the throttle body.

In this known throttle control device, when the acceleration pedal is depressed, the resultant depression amount is determined by a throttle sensor. A signal indicative of the depression amount of the acceleration pedal is issued from the throttle sensor and the motor is driven to rotate the throttle valve through an angle in response to the signal. Thus, the amount of air to be taken into the internal combustion engine is adjusted. Such an adjustment is established with well-known feedback control or PID control (Proportion-Integration-Differential Control) in such manner that the actual opening amount of the throttle valve which is indicated by the signal from the throttle sensor is compared to a target opening amount of the throttle valve which is indicated by the signal of the acceleration sensor for converging the deviation between the two values to zero.

However, with the above-construction, the cover and the throttle sensor are provided separately, thus requiring an independent fixation mounting of each of the cover and the throttle sensor to the throttle body. Thus, the number of parts is increased, with the result that the production cost is increased and the assembly of the device is more complicated.

Accordingly, a need exists for a throttle control device that is not as susceptible to the foregoing disadvantages and drawbacks.

It would thus be desirable to provide a throttle control device possessing a simpler construction and capable of being more easily assembled and with a lower production cost.

SUMMARY OF THE INVENTION

According to one aspect of the invention, a throttle control device includes a throttle body, a throttle shaft journalled on the throttle body, a throttle valve accommodated in the throttle body and mounted on the throttle shaft for adjusting an amount of air passing through the intake passage of the internal combustion engine, a motor coupled via a power transmission mechanism to the throttle shaft for driving the throttle valve in a closing direction and an opening direction to adjust the amount of opening of the throttle valve, and a cover connected to the throttle body and enclosing the power transmission mechanism. The cover includes a built-in throttle sensor for determining the amount of opening of the throttle valve. A connecting member connects the throttle sensor and the throttle shaft.

According to the present invention, the cover forms the body of the throttle sensor and only one portion is required for connecting the cover to the throttle body. This advantageously decreases the number of parts, thereby reducing the production cost of the throttle control device and simplifying the assembly. In addition, the concentration or integration of parts brings about a reduction in the overall size of the throttle control device.

The present invention also provides an integral connecting portion on the cover which is provided with terminals to be electrically coupled to the motor and the throttle sensor, respectively. The electric coupling operations to the throttle control device are thus significantly improved, thereby facilitating or making easier the mounting operation of the throttle valve control device on the internal combustion engine.

Also, according to the present invention, the throttle sensor includes a sensor shaft journaled in the cover and biased toward a direction of closing the throttle valve, the sensor shaft is fixed with the connecting member in order that the connecting member is engagible with a projection formed at an end of the throttle shaft in the direction of closing the throttle valve, and a guide member is provided at either the connecting member or the projection for rotating the sensor shaft in the direction of opening the throttle valve when the cover is mounted to the throttle body. The guide portion allows the connecting member to engage the throttle shaft in the direction of closing throttle valve and this ensures a reliable transmission of rotation from the throttle shaft to the sensor shaft without rattling, thereby deriving a voltage signal from the throttle sensor which is in response to the opening amount of the throttle valve. Moreover, in the event the sensor shaft fails to rotate, the throttle sensor issues a higher voltage signal than a voltage signal indicative of the actual opening amount of the throttle valve, with the result that the motor is driven in the direction of closing the throttle valve so as to decrease the voltage signal from the throttle sensor. Thus, the output power of the internal combustion engine is decreased, thereby ensuring vehicle safety.

According to another aspect of the invention, a throttle control device includes a throttle body, a throttle shaft journalled on the throttle body, a throttle valve accommodated in the throttle body and mounted on the throttle shaft for adjusting the amount of air passing through the intake passage of the internal combustion engine, a motor coupled via a power transmission mechanism to the throttle shaft for driving the throttle valve in a closing direction and an opening direction to adjust the amount of opening of the throttle valve, and a cover secured to the throttle body to enclose the power transmission mechanism. A throttle sensor is mounted on the cover so that connecting the cover to the throttle body results in mounting of the throttle sensor on the throttle. The throttle sensor is operatively connected to the throttle shaft body for determining the amount of opening of the throttle valve.

In accordance with another aspect of the invention, a throttle control device for a vehicle includes a throttle body, a throttle shaft journalled on the throttle body, a throttle valve accommodated in the throttle body and mounted on the throttle shaft for adjusting the amount of air passing through the intake passage of the internal combustion engine, a motor coupled via a power transmission mechanism to the throttle shaft for driving the throttle valve in a closing direction and an opening direction to adjust the amount of opening of the throttle valve, and a cover connected to the throttle body to enclose the power transmission mechanism. A throttle sensor is operatively connected to the throttle shaft for determining the amount of opening of the throttle valve. The cover includes an integrally formed connecting portion at which are exposed a plurality of terminals that are electrically connected to the motor and the throttle sensor.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE INVENTION

Figure 1:
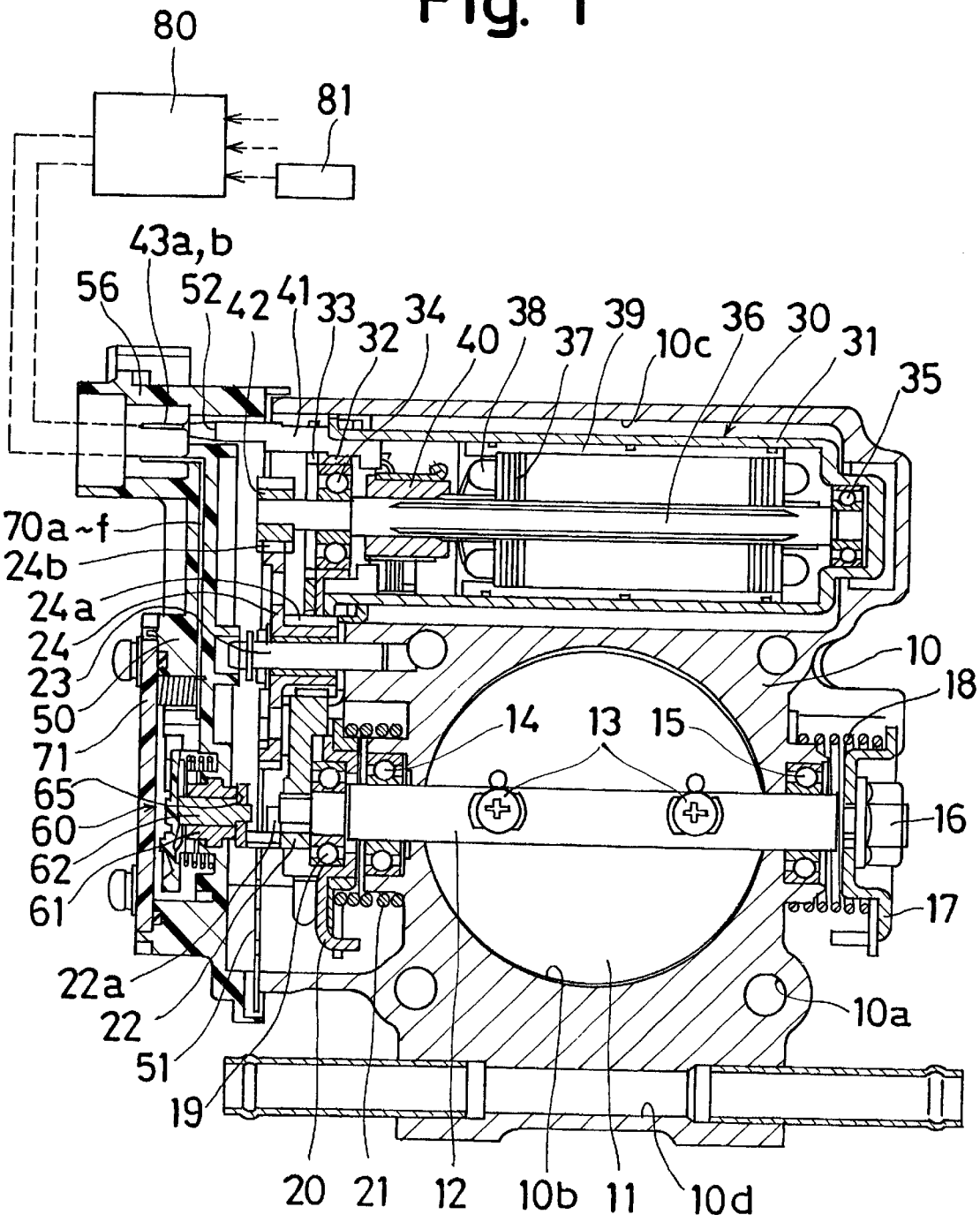
FIG. 1 is a cross-sectional view of a throttle control device in accordance with an embodiment of the present invention.

With reference to FIG. 1, a throttle control device in accordance with the present invention includes a throttle body 10 formed of aluminum so as to be lightweight while also possessing excellent heat radiation properties. The throttle body 10 is formed with four holes 10*a* through which respective bolts extend for mounting the throttle body 10 on the intake manifold of an internal combustion engine. The throttle body 10 is provided with an intake passage 10*b* in which an annular-shaped or disk-shaped throttle valve 11 is provided. The throttle valve 11 is positioned in an axial slit that is formed in a throttle shaft 12. The throttle valve 11 is fixed to the throttle shaft 12 by two screws 13, 13 to produce an integrated construction of the throttle valve 11 and the throttle shaft 12. The throttle shaft 12 includes opposite end portions and each of these end portions of the throttle shaft 12 is journalled in the throttle body 10 via a respective bearing 14, 15. A water passage is also formed in the throttle body 10 through which cooling water passes for cooling the throttle body 10 and the internal combustion engine.

A retainer 17 is fixed at the extreme right end of the throttle shaft 12 by a nut 16. The retainer 17 is engaged by one end of a return spring 18 while the opposite end of the spring 18 engages the throttle body 10. The return spring 18 continually urges the throttle valve 11 into its closing position. A bearing 19 and a sector or final gear 22 are fixedly mounted on the left end of the throttle shaft 12 so that no relative movement occurs therebetween. A retainer 20 is fixedly mounted on the outer race of the bearing 19. The retainer 20 is adapted to engage the final gear 22 when the throttle valve 11 is driven in its opening direction.

One end of an opener spring 21 engages the retainer 20 and the opposite end of the opener spring 21 engages the throttle body 10. The opener spring 21 applies an urging force which acts on the throttle valve 11 by way of the retainer 20 and the final gear 22 for continually urging the throttle valve 11 in its opening direction by overcoming the urging force of the return spring 18.

The retainer 20 possesses a projection 20*a*. As seen with reference to FIG. 2, the projection 20*a* engages a default opening degree adjusting screw 25 which is provided in the throttle body 10. This screw 25 mechanically establishes a default opening degree θ, as will be described in more detail below, even when a motor 30 is inactive. As mentioned above, because the retainer 20 engages the final gear 22 in the direction of opening the valve 11, when the projection 20*a* is, at its default position, in engagement with the screw 25, if the motor 30 is activated for concurrent rotation of the final gear 22 and the throttle valve 11 in the direction of opening the throttle valve 11, the final gear 22 is brought into rotation relative to the retainer 20. On the other hand, if the motor 30 is activated for concurrent rotation of the final gear 22 and the throttle valve 11 in the direction of closing the throttle valve 11, the final gear 22 is brought into rotation together with the retainer 20.

A fully-closing angle adjusting screw 26 is also provided in the valve body 10. When the final gear 22 is brought into engagement with fully-closing angle adjusting screw 26, the throttle valve 11 assumes its full closing position at which the passage 10*b* is fully closed.

A mounting bore 10*c* is formed in the throttle body 10 and is disposed perpendicular to the intake passage 10*b*. The motor 30 is accommodated in the mounting bore 10*c*. The motor 30 includes a housing 31 formed of a magnetic material which acts as a yoke. The housing is in the form of a cylinder with one end closed and the other opened. The housing 31 is fitted in the mounting bore 10*c* and the open end of the housing 31 is connected via a first plate 32 to a second plate 33 that is fixed to the throttle body 10 by a screw mechanism. The housing 31 is thus immovable or fixed in the mounting bore 10*a* of the throttle valve 10.

A shaft 36 is positioned in the housing 31 and includes opposite ends (i.e., a right end and a left end) that are rotatably supported by respective axially spaced bearings 34, 35. The left end bearing 34 is fixed to the first plate 32 and the right end bearing 35 is fixed to the closed end or bottom of the housing 31. A rotor 37 is fixedly mounted on the shaft 36. The rotor 37 is in the form of a plurality of stacked annular-shaped thin plates made of magnetic material. A cylindrically-shaped magnet 39 is adhered to the inner surface of the housing 31. The rotor shaft 36 is in slidable contact with a brush mechanism connected to the housing 31 via a holder. The brush mechanism is connected to connecting terminals 43*a*, 43*b*, as will be described below in more detail, which are accommodated in a casing 41. A commutator 40 is also located within the housing 31 in surrounding relation to the shaft 36.

Figure 2:
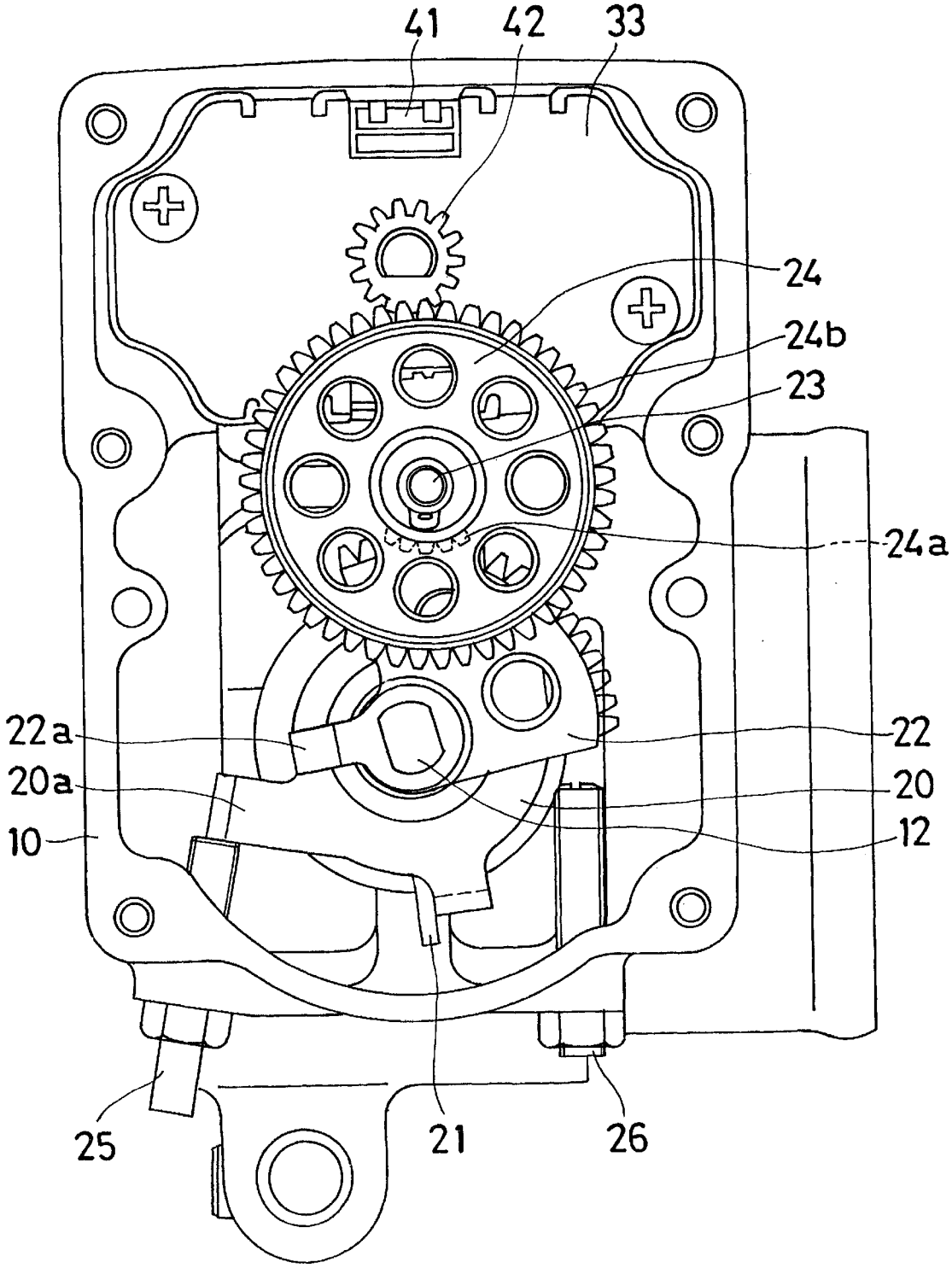
FIG. 2 is a side view of the throttle control device shown in FIG. 1 in which the throttle body cover has been removed.

As shown in FIGS. 1 and 2, a pinion gear 42 is fixedly mounted on the end of the rotor shaft 36 extending from the open end of the housing 31. The pinion gear 42 is in meshing engagement with a first gear portion 24*b* of a secondary gear 24 which is rotatably mounted on a shaft 23 that is fixed to the throttle body 10. The secondary gear 24 also has a second gear portion 24*a* of smaller diameter than the first gear portion 24*b*. The second gear portion 24*a* is in meshing engagement with the final gear 22. The pinion gear 42, the secondary gear 24 and the final gear 22 together constitute a gear train or a power transmission mechanism.

Figure 5:
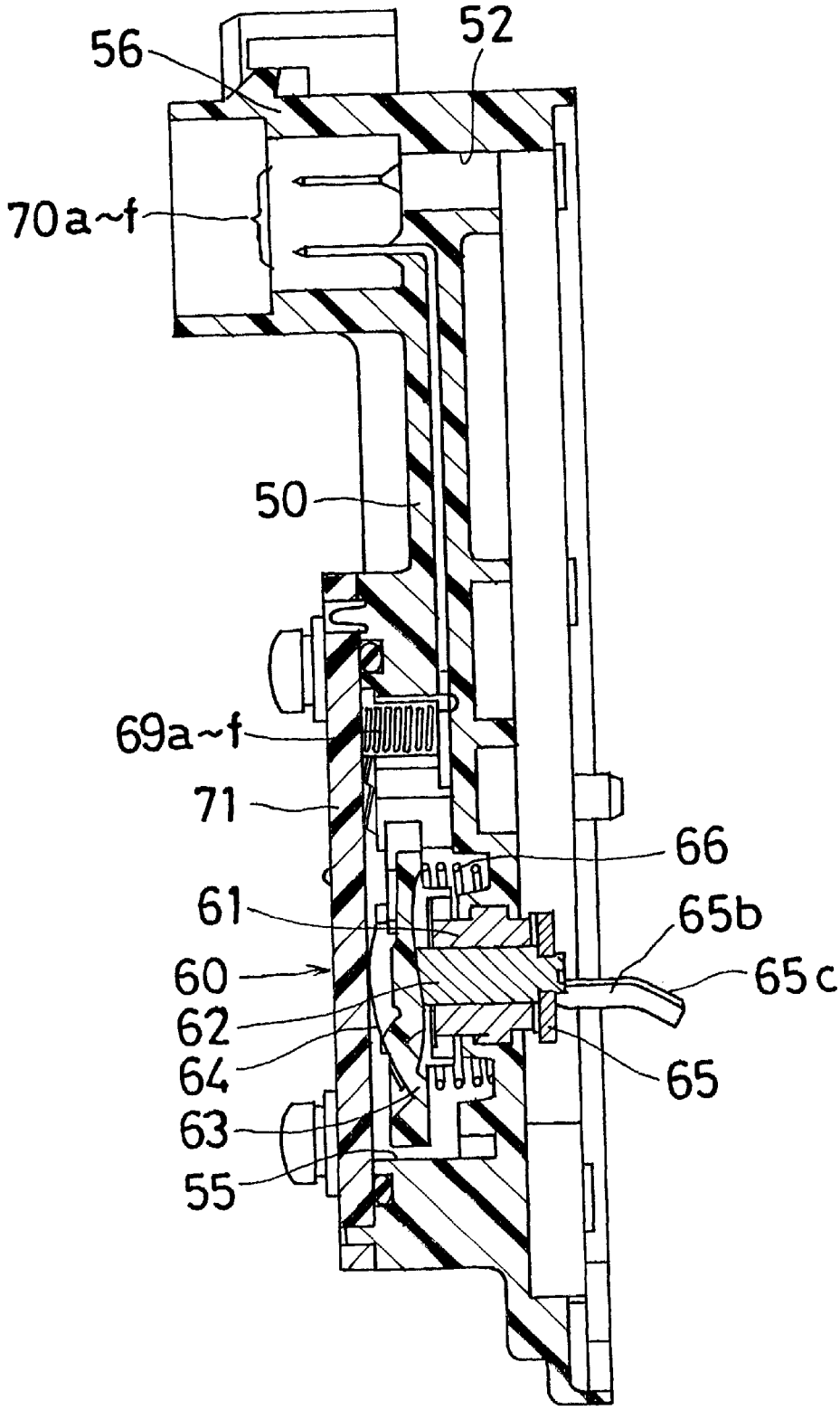
FIG. 5 is an enlarged cross-sectional view of the throttle body cover.
Figure 6:
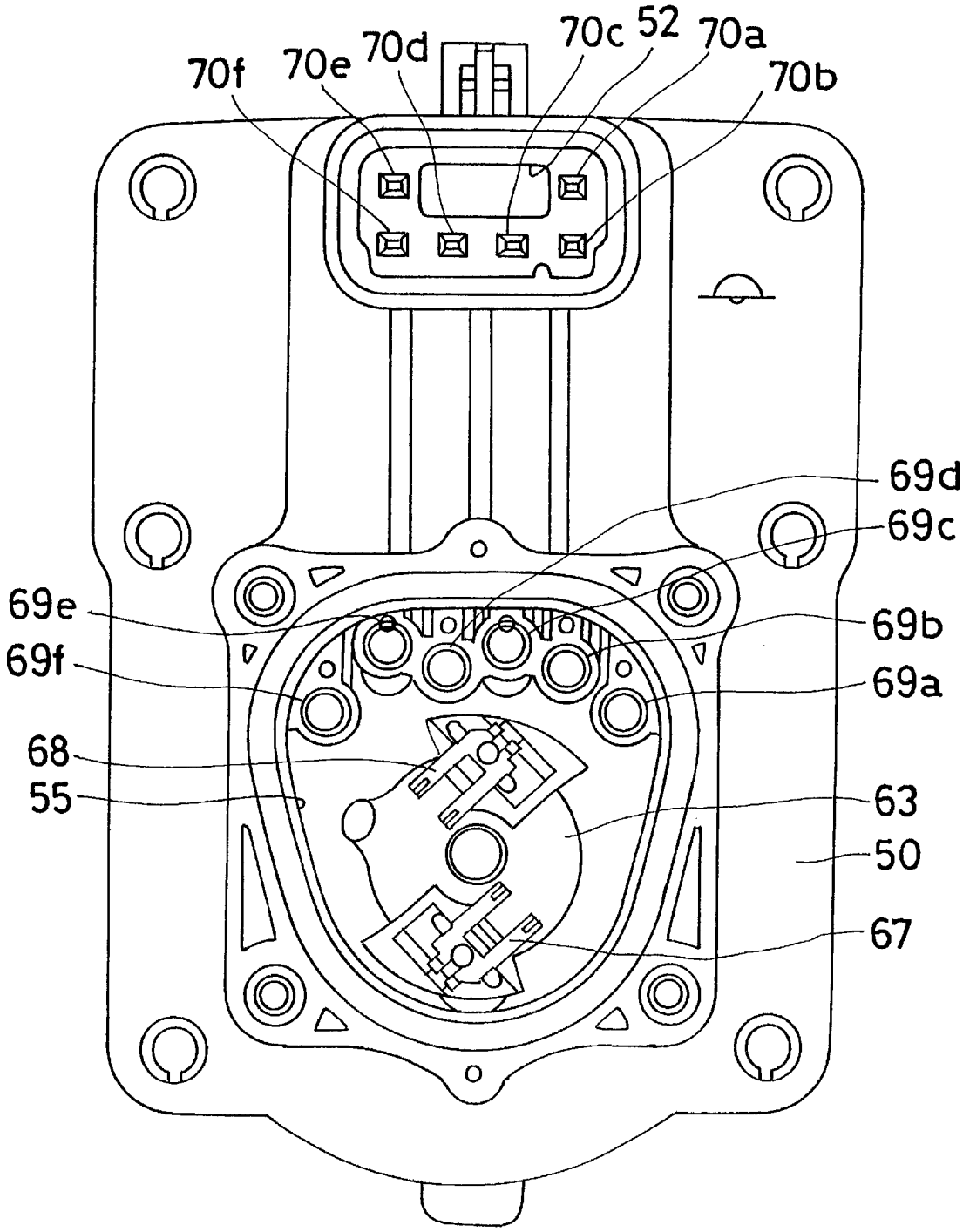
FIG. 6 is a front view of the throttle body cover.

A resin-made throttle body cover 50 is connected via a gasket 51 to one side of the throttle body 10 to enclose or cover the gear train or a power transmission mechanism formed by the pinion gear 42, the secondary gear 24, and the final gear 22. As best shown in FIGS. 5 and 6, the throttle body cover 50 accommodates a pair of throttle sensors 60, 60, each of which is adapted to determine or measure the throttle opening amount or the degree of opening of the throttle valve 11. The outwardly facing side of the throttle body cover 50 is provided with a hollow portion 55 that is covered or closed in a fluid-tight manner by a resin-made plate 71. The plate 71 is connected to the throttle body 10 by screws.

Figure 7:
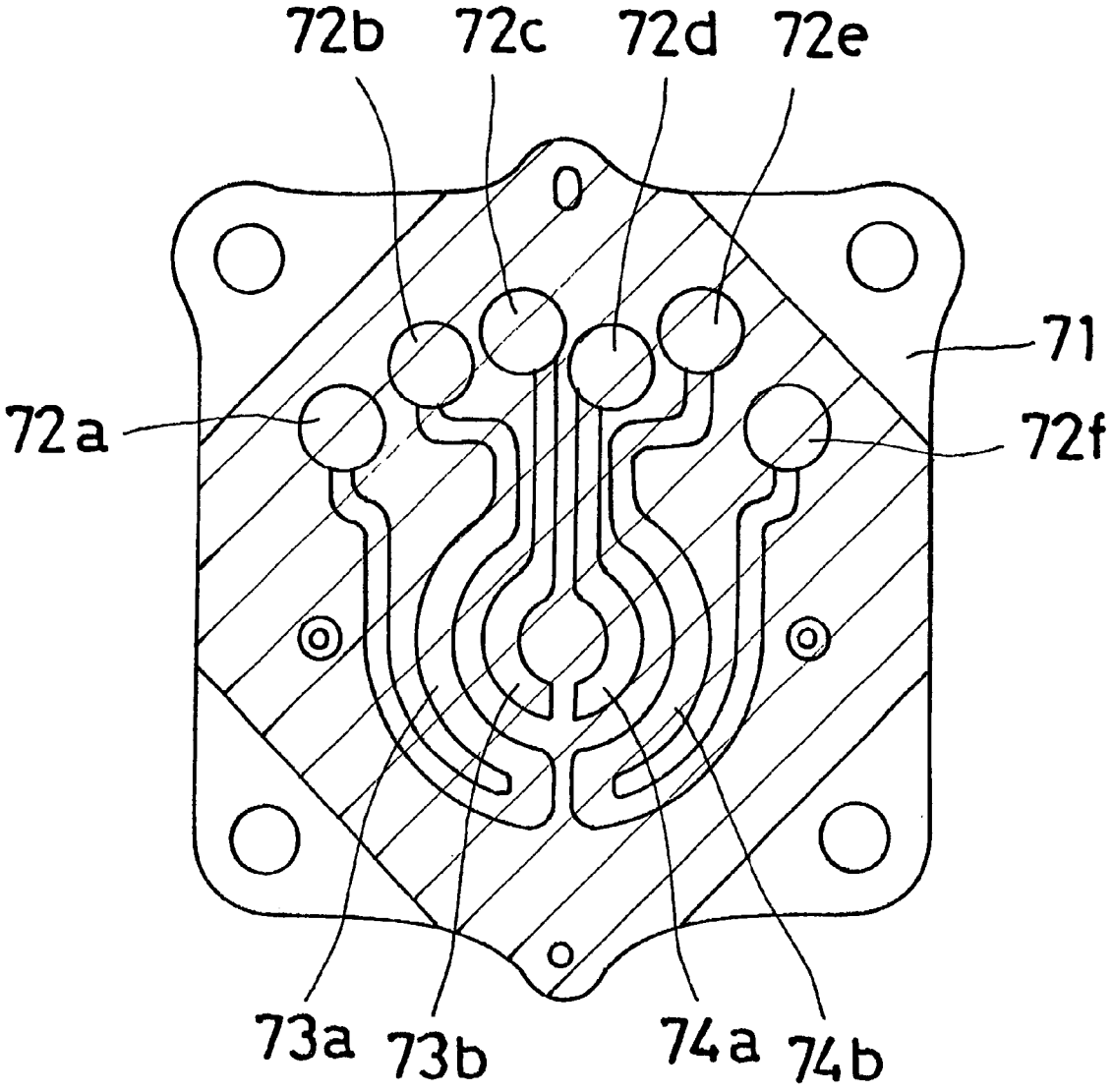
FIG. 7 is a plan view of the substrate employed in the throttle control device in FIG. 1.

As shown in FIG. 7, the inwardly facing side of the plate 71 which opposes the hollow portion 55 of the throttle body cover 50 is provided with four electrically isolated resistors 73*a*, 73*b*, 74*a*, 74*b* having main or arc-shaped portions that are arranged in a concentric manner. The ends of the resistor 73*a* form terminals 72*a*, 72*b*, while the ends of the resistor 74*b* form terminals 72*e*, 72*f*. One end of the resistor 73*b* and one end of the resistor 74*a* constitute terminals 72*c*, 72*d*, respectively.

A sensor shaft 62 is journaled in the throttle body cover 50 via a bushing 61 so that the sensor shaft 62 is coaxial with the throttle shaft 12. One end of the sensor shaft 62 extend into the hollow portion 55 and the opposite end of the sensor shaft 62 extends into a space in which the aforementioned gear train is accommodated. In the hollow portion 55, one end of the sensor shaft 62 is fixed with a holder 63 that holds a pair of brushes 67, 68. The brushes 67, 68 possess forked or bifurcated configurations. Each of the forked or bifurcated configurations has a first contact portion and a second contact portion which are engagible with the set of resistors 73*a*, 74*b* and the set of resistors 73*b*, 74*a*, respectively. As seen in FIG. 5, a return spring 66 is operatively associated with the sensor shaft 62 and continually urges the sensor shaft 62 in the direction of closing of the throttle valve 11.

Six accommodating portions are formed in the hollow portion 55 of the throttle body cover 50 as generally shown in FIGS. 5 and 6. Each accommodating portion extends toward the plate 71 in parallel to the sensor shaft 62 and has an opening exposed to or facing towards the plate 71. A plurality of coil springs 69*a*–69*f* are also provided and each coil spring is loosely fitted in one of the accommodating portions. The coil springs 69*a*–69*f* are formed of a wire having electric conductivity.

As shown in FIGS. 5 and 6, the cover 50 is also outfitted with a plurality of terminals 70*a*–70*f* that are adapted to be operatively associated with respective ones of the coil springs 69*a*, 69*b*, 69*c*, 69*d*, 69*e*, 69*f*. When the cover 50 is mounted in place, the coil spring 69*a* is interposed between the terminal 72*a* and a terminal 70*a*, the coil spring 69*b* is interposed between the terminal 72*b* and a terminal 70*b*, the coil spring 69*c* is interposed between the terminal 72*c* and a terminal 70*c*, the coil spring 69*d* is interposed between the terminal 72*d* and a terminal 70*d*, the coil spring 69*e* is interposed between the terminal 72*e* and a terminal 70*e*, and the coil spring 69*f* is interposed between the terminal 72*f* and a terminal 70*f*. The terminals 70*a*, 70*b*, 70*c*, 70*d*, 70*e*, 70*f* extend into the bottoms of the respective accommodating portions that receive the respective coil springs 69*a*, 69*b*, 69*c*, 69*d*, 69*e*, 69*f*. Thus, in accordance with the present invention, the terminals 70*a*–70*f* are integral with and form a unitary one-piece construction with the throttle body cover 50 so that the terminals 70*a*–70*f* make connection with the respective coils springs 69*a*, 69*b*, 69*c*, 69*d*, 69*e*, 69*f* upon mounting the throttle body cover 50 in place on the throttle body 10.

As illustrated in FIG. 1, the throttle body cover 50 is provided with an integral socket-like connector portion 56 for effecting connection with a controller 80. The connector portion 56 is thus integral with and formed in one piece as a unitary structure with the throttle body. As seen with reference to FIG. 6, the terminals 70*a*–70*f* are accommodated or exposed in the connector portion 56. The connector portion 56 is formed with a passage 52 which connects the connector portion 56 and the space in which is accommodated the gear train. As shown in FIG. 1, the case 41 which accommodates the terminals 43*a*, 43*b* of the motor 30 is fitted in the passage 52.

When the throttle body cover 50 is mounted onto the throttle body 10, the set of terminals 43*a*, 43*b*, as well as the terminals of the throttle sensors, are accommodated in the connector portion 56. It is to be noted that the distal end of each of the terminals 43*a*, 43*b* is the same as that of each of the terminals 70*a*–70*f*.

The terminals 70*b*, 70*f* are fed with electric power via the controller 80, while terminals 70*a*, 70*e* are grounded. This allows voltage signals to be issued from the terminals 70*c*, 70*d* which are of different directions and which vary in magnitude in response to rotation of the sensor shaft 62. Of course, it is possible, by changing the grounded terminals, to issue the same voltage signals from the terminals 70*c*, 70*d*.

Figure 3:
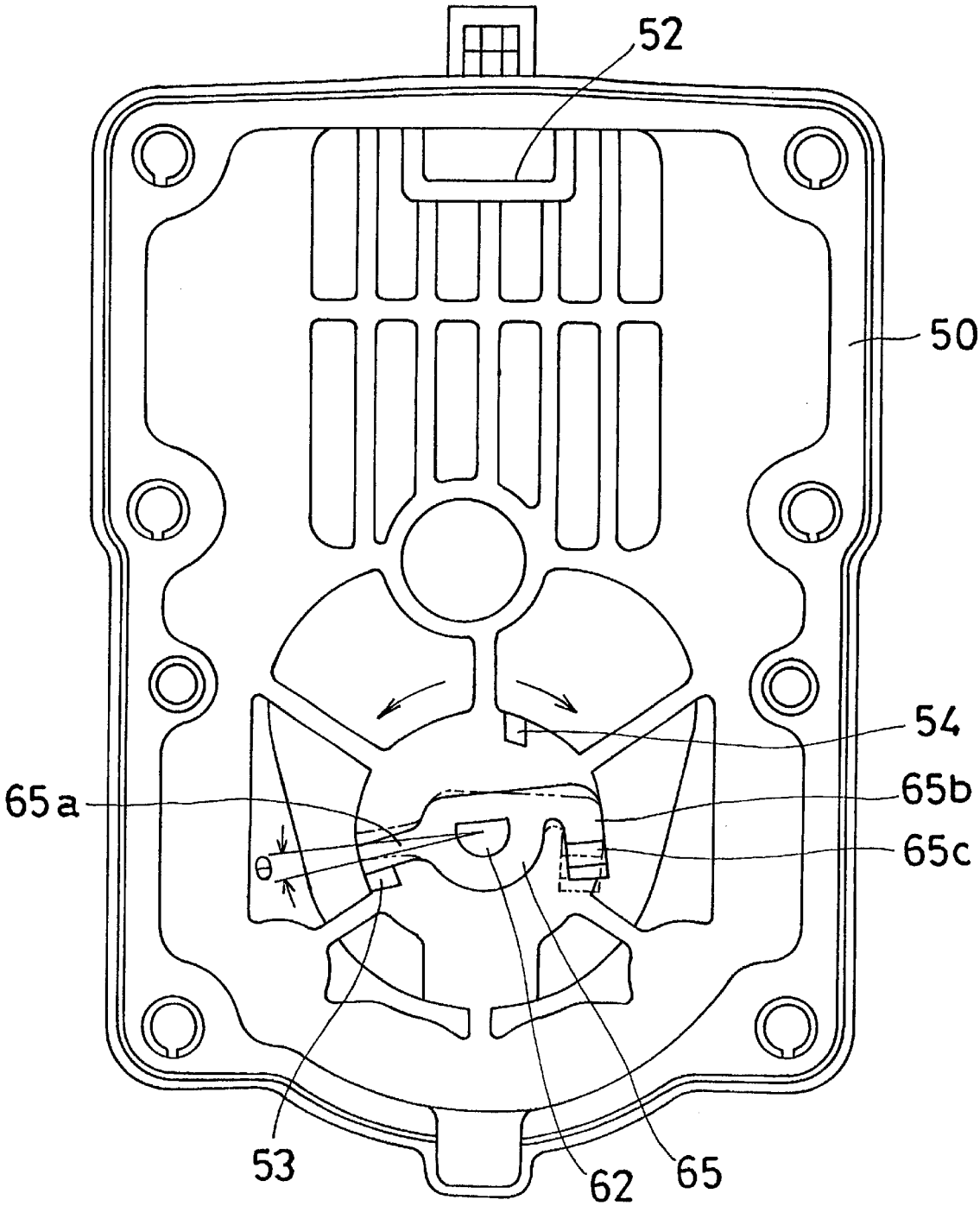
FIG. 3 is a rear view of the throttle body cover employed in the throttle control device shown in FIG. 1.

As shown in FIGS. 3 and 5, a lever 65 acting as a connecting member is secured to the end of the sensor shaft 62 which extends into the space in which the gear train, including the final gear 22, is located. The lever 65 has a first projection 65*a* which extends in the radial direction with respect to the sensor shaft 62 and a second projection 65*b*. The second projection 65*b* extends with respect to the sensor shaft 62 in a direction opposite to the first projection 65*a*, and then bends so as to extend parallel to the sensor shaft 62. For regulating a fully closed position and a fully opened position of the throttle sensor 60, the first projection 65*a* of the lever 65 is engagible with one of two angularly spaced or rotationally displaced stoppers in response to the angular position or rotational angle of the sensor shaft 62. The two stoppers include a full-close stopper 53 and a full-open stopper 54 which are formed on the throttle body cover 50 so as to be exposed to or face the space in which is accommodated the gear train that includes the final gear 22.

Prior to the connection of the throttle body cover 50 to the throttle body 10, the first projection 65*a* of the lever 65 is in engagement with the full-close stopper 53 as depicted in the full line outline in FIG. 3 due to the fact that the sensor shaft 62 is urged in the direction of closing of the throttle valve 11 by the return spring 66. The position regulated by the full close stopper 53 is nearer to the fully closed position of the throttle valve 11 than the position regulated by the screw, while the position regulated by the full open stopper 54 is nearer to the fully opened position of the throttle valve 11 than the position regulated by an engagement of the retainer with the throttle body 10.

Figure 4:
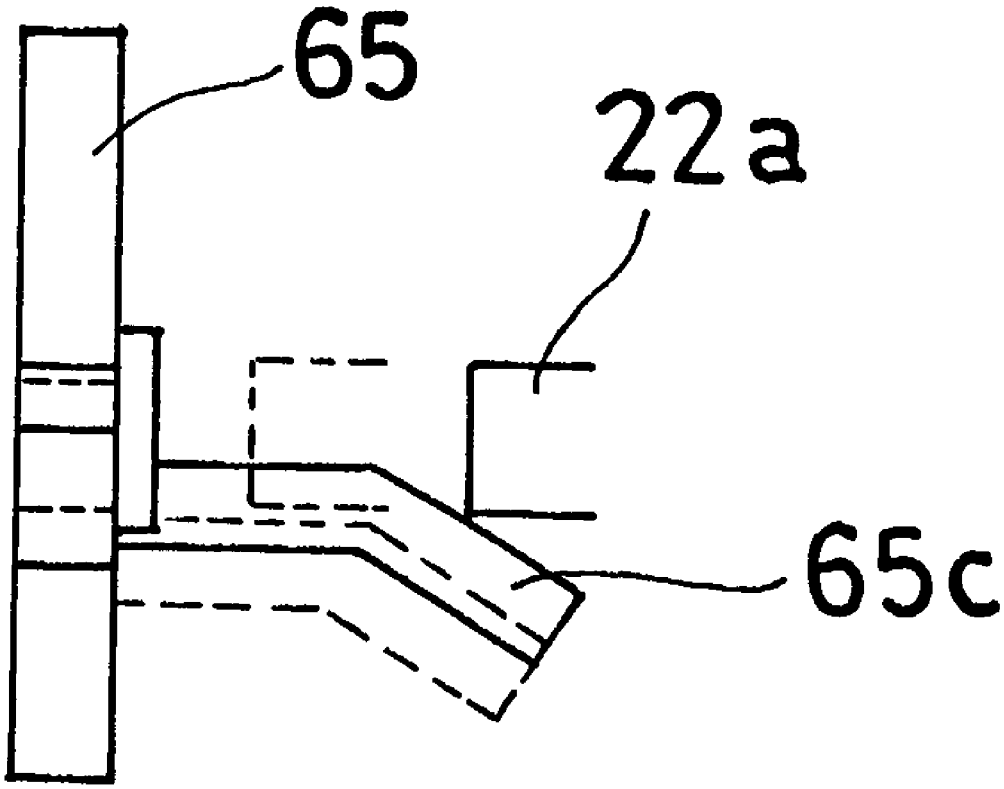
FIG. 4 is a side view showing the relationship between the lever of the throttle sensor and the projection of the final gear when the throttle body cover is coupled to the throttle body.

As shown in FIGS. 3 and 4, the distal end or free end portion of the second projection 65*b* of the lever 65 is configured to form a bent guide portion 65*c*. At the default position as previously explained, a projection 22*a* formed as an integral extension of the final gear 22 extends toward the guide portion 65*c* in parallel to the sensor shaft 62. The bent guide portion 65*c* of the lever 65 has a slanted surface and when the projection 22*a* of the final gear 22 is brought into engagement with the guide portion 65*c* of the lever 65 under a force, the resultant component force urges or applies a force to the slant or bent portion 65*c* of the lever 65, thus causing rotation of the guide portion. Thus, in the course of fixing the throttle body cover 50 to the throttle body 10, when the projection portion 22*a* of the final gear 22 is urged onto the slant or bent guide portion 65*a* of the lever 65 while inserting the case 41 into the mounting bore 52, as can be seen from FIGS. 3 and 4, the lever 65 is rotated through the angle θ from the fully closed position, thereby engaging the second projection 65*b* of the lever 65 with the projection 22*a* toward the fully closed position. Thus, the sensor shaft 62 is rotated through an angle between the fully closed and opened positions thereof, depending on the angular position of the final gear 22. The result is that the voltage signals from the respective terminals 70*c*, 70*d* are derived and are in proportion to the opening amount of the throttle valve 11.

In the foregoing structure, when the acceleration pedal is depressed, the amount or degree of acceleration corresponding to the amount of depression of the acceleration pedal is determined by an acceleration sensor 81, with a signal being fed from the sensor to the controller 80. Depending on such signal, current is supplied via the controller 80 to the motor 30, which causes an initiation of the motor 30, thereby operating the throttle valve 11 to adjust the amount of intake air passing through the intake passage 10*b* formed in the throttle body 10. At this time, the controller 80 controls the motor 30 under feedback or PID control in such a manner that the actual opening amount of the throttle valve 11 which is indicated by the signal from the throttle sensor 60 is compared to a target opening amount of the throttle valve 11 which is indicated by the signal from the acceleration sensor 81 to calculate a deviation between the two signals, and with the deviation converging to zero.

As previously explained, the throttle sensors 60 are accommodated within and secured to the throttle body cover 50, thus allowing the throttle body cover 50 to be used as the body or mounting mechanism of the throttle sensor 60. The throttle sensors 60 thus form a built-in part of the throttle body cover 50. Thus, mounting the throttle body cover 50 on the throttle body 10 in a fixing manner includes the concurrent mounting of the sensors 60 in the throttle body 10. This advantageously eliminates screws and the like previously required for proper mounting of each of the throttle sensor body and the throttle sensors per se on the throttle body, and decreases the number of parts. The present invention thus allows realization of reduced production costs associated with the throttle control device. In addition, the assembly of the throttle control device is simplified and the size of the throttle control device can be reduced.

The terminals for both the throttle sensor 60 and the motor 30 are accommodated in the sole or common connector portion 56 which is integrally formed in the throttle body 50. This markedly improves the electric coupling operation between the throttle device and the controller 80, thereby easing or facilitating the mounting operation of the throttle valve control device on the internal combustion engine.

The cam action that occurs between the guide portion 65*a* of the lever 65 and the projection 22*a* of the final gear 22 causes rotation of the lever 65 through an angle θ from the stopper position in the valve opening direction, thus ensuring, without disturbing the assembly operation, engagement of the second projection 65*b* of the lever 65 under the bias force of the return spring 66 with the projection 22*a* of the final gear 22 in the valve closing direction. The full-close position of the lever 65 which is regulated by the stopper 53 is offset an angle toward the valve closing side from the full-close position of the throttle valve 11 which is regulated by the screw 26. The result is that when the throttle valve 11 takes its full-close position no separation is made between the projection 22*a* of the final gear 22 and the second projection 65*b* of the lever 65 even if manufacturing tolerances of the parts fall outside of the allowable ranges. Thus, the rotation of the throttle shaft 12 is reliably transmitted to the sensor shaft 62 without rattling and so the throttle sensor 60 is able to provide a voltage signal that is accurately indicative of the opening amount of the throttle valve 11. In addition, in the event the sensor shaft 62 does not rotate, the throttle sensor 60 issues a higher signal than a signal indicative of the actual opening amount of throttle opening, thus making the controller 80 drive the motor 30 in the closing direction of the throttle valve 11 for lowering the issued voltage signal from the throttle sensor 60, and thereby decreasing the output power of the internal combustion engine which improves vehicle safety.

The full-open position of the lever 65 which is regulated by the stopper 54 is offset an angle toward the valve open side from the full-open position at which the retainer 17 is in engagement with the throttle body 10. Until the throttle valve 11 takes its full-close position the first projection 65*a* of the lever 65 is prevented from being in engagement with the full-open stopper 54. The throttle valve 11 is thus ensured to be driven or transferred to the desired full-open position.

Instead of the structure described above in which the guide portion 65*c* is provided on the second projection 65*b* of the lever 65, it is possible to form such a guide portion on the projection 22*a* of the final gear 22, or to provide a guide portion on both the projection 22*a* of the final gear 22 and the second projection 65*b* of the lever 65.

The principles, preferred embodiment and mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A throttle control device comprising;

a throttle body;

a throttle shaft journalled on the throttle body;

a throttle valve accommodated in the throttle body and mounted on the throttle shaft for adjusting an amount of air passing through an intake passage of an internal combustion engine;

a motor coupled via a power transmission mechanism to the throttle shaft for driving the throttle valve in a closing direction and an opening direction to adjust an amount of opening of the throttle valve, the motor including a case which accommodates a pair of terminals;

a cover connected to the throttle body and enclosing the power transmission mechanism, said cover including a built-in throttle sensor for determining the amount of opening of the throttle valve, said terminals being fitted into a passage in the cover with the terminals accessible from outside the cover; and a connecting member connecting the throttle sensor and the throttle shaft.

2. A throttle control device as set forth in claim 1, wherein the cover possesses an integral connecting portion at which are exposed said terminals as well as terminals that are electrically coupled to the throttle sensor.

3. A throttle control device as set forth in claim 2, wherein the throttle sensor includes a sensor shaft journalled in the cover and biased toward the closing direction of the throttle valve, the connecting member being fixed to the sensor shaft and being engaged with a projection formed at an end of the throttle shaft.

4. A throttle control device as set forth in claim 3, wherein a guide member is provided at one of the connecting member and the projection to rotate the sensor shaft in the opening direction of the throttle valve when the cover is mounted to the throttle body.

5. A throttle control device as set forth in claim 1, wherein the throttle sensor includes a sensor shaft journalled in the cover and biased toward the closing direction of the throttle valve, the connecting member being fixed to the sensor shaft and being engaged with a projection formed at an end of the throttle shaft.

6. A throttle control device as set forth in claim 5, wherein a guide member is provided at one of the connecting member and the projection to rotate the sensor shaft in the opening direction of the throttle valve when the cover is mounted to the throttle body.

7. A throttle control device as set forth in claim 1, including a plurality of terminals electrically coupled to the throttle sensor, said terminals that are electrically coupled to the throttle sensor being integrated into and forming a part of the cover.

8. A throttle control device as set forth in claim 1, wherein the throttle body includes a mounting bore in which is positioned a housing that houses the motor, one end of said housing being connected to a case in which are accommodated the terminals connected to the motor.

9. A throttle control device comprising;

a throttle body;

a throttle shaft journalled on the throttle body;

a throttle valve accommodated in the throttle body and mounted on the throttle shaft for adjusting an amount of air passing through an intake passage of an internal combustion engine;

a motor coupled via a power transmission mechanism to the throttle shaft for driving the throttle valve in a closing direction and an opening direction to adjust an amount of opening of the throttle valve, the motor including a case which accommodates a pair of terminals;

a cover secured to the throttle body to enclose the power transmission mechanism, said terminals being fitted into a passage of the cover with the terminals accessible from outside the cover;

a throttle sensor mounted on the cover so that connecting the cover to the throttle body results in mounting of the throttle sensor on the throttle, said throttle sensor being operatively connected to the throttle shaft body for determining the amount of opening of the throttle valve.

10. A throttle control device as set forth in claim 9, wherein the cover possesses an integral connecting portion at which are exposed said terminals as well as terminals that are electrically coupled to the throttle sensor.

11. A throttle control device as set forth in claim 10, wherein the connecting portion is a socket at which said terminals are exposed.

12. A throttle control device as set forth in claim 9, wherein the throttle sensor includes a sensor shaft journalled in the cover and biased toward the closing direction of the throttle valve, the throttle sensor being operatively connected to the throttle shaft by a connecting member that is fixed to the sensor shaft engages a projection formed at an end of the throttle shaft.

13. A throttle control device as set forth in claim 12, including a guide member provided at one of the connecting member and the projection to rotate the sensor shaft in the opening direction of the throttle valve when the cover is mounted to the throttle body.

14. A throttle control device as set forth in claim 9, including a plurality of terminals electrically coupled to the throttle sensor, said terminals that are electrically coupled to the throttle sensor being integrated into and forming a part of the cover.

15. A throttle control device comprising:

a throttle body;

a throttle shaft journalled on the throttle body;

a throttle valve accommodated in the throttle body and mounted on the throttle shaft for adjusting an amount of air passing through an intake passage of an internal combustion engine;

a motor coupled via a power transmission mechanism to the throttle shaft for driving the throttle valve in a closing direction and an opening direction to adjust an amount of opening of the throttle valve;

a cover secured to the throttle body to enclose the power transmission mechanism; and a throttle sensor mounted on the cover so that connecting the cover to the throttle body results in mounting of the throttle sensor on the throttle, said throttle sensor being operatively connected to the throttle shaft body for determining the amount of opening of the throttle valve;

wherein the throttle body includes a mounting bore in which is positioned a housing that houses the motor, one end of said housing being connected to a case in which are accommodated terminals connected to the motor.

16. A throttle control device comprising;

a throttle body;

a throttle shaft journalled on the throttle body;

a throttle valve accommodated in the throttle body and mounted on the throttle shaft for adjusting an amount of air passing through an intake passage of an internal combustion engine;

a motor coupled via a power transmission mechanism to the throttle shaft for driving the throttle valve in a closing direction and an opening direction to adjust an amount of opening of the throttle valve, the motor including a case which accommodates a pair of terminals;

a cover connected to the throttle body to enclose the power transmission mechanism, said terminals being fitted into a passage of the cover with the terminals accessible from outside the cover; and a throttle sensor operatively connected to the throttle shaft for determining the amount of opening of the throttle valve, said cover including an integrally formed connecting portion at which are exposed a plurality of terminals electrically connected to the motor and the throttle sensor.

17. A throttle control device as set forth in claim 16, wherein the throttle sensor is mounted on the cover so as to be fixed in position with respect to the cover.

18. A throttle control device as set forth in claim 16, wherein the throttle sensor is operatively connected to the throttle shaft by a connecting member that is fixed to the sensor shaft and a projection formed at an end of the throttle shaft, said connecting member engaging said projection.

19. A throttle control device as set forth in claim 18, including a bent guide member provided at one of the connecting member and the projection to rotate the sensor shaft in the opening direction of the throttle valve when the cover is mounted to the throttle body.

20. A throttle control device as set forth in claim 16, including a plurality of terminals electrically coupled to the throttle sensor, said terminals that are electrically coupled to the throttle sensor being integrated into and forming a part of the cover.

* * * * *